US009353968B2

(12) United States Patent
Hayakawa

(10) Patent No.: US 9,353,968 B2
(45) Date of Patent: May 31, 2016

(54) HEAT SOURCE UNIT OF REFRIGERATING APPARATUS

(71) Applicant: DAIKIN INDUSTRIES, LTD., Osaka-shi, Osaka (JP)

(72) Inventor: Hironori Hayakawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 131 days.

(21) Appl. No.: 14/228,087

(22) Filed: Mar. 27, 2014

(65) Prior Publication Data

US 2015/0276263 A1 Oct. 1, 2015

(51) Int. Cl.

| | |
|---|---|
| ***F24H 3/02*** | (2006.01) |
| ***F25B 39/04*** | (2006.01) |
| ***F24H 3/00*** | (2006.01) |
| ***F24F 1/24*** | (2011.01) |
| ***F24F 1/50*** | (2011.01) |

(52) U.S. Cl.
CPC *F24H 3/022* (2013.01); *F24F 1/24* (2013.01); *F24F 1/50* (2013.01); *F24H 3/002* (2013.01)

(58) Field of Classification Search
None
See application file for complete search history.

(56) References Cited

U.S. PATENT DOCUMENTS 5,748,445 A * 5/1998 North ..... H05K 7/20418 165/185
7,961,462 B2 * 6/2011 Hernon ..... H05K 7/20145 165/109.1
8,978,393 B2 * 3/2015 Hika ..... F24F 1/22 62/298
2002/0134099 A1 * 9/2002 Mochizuki ..... F24F 1/18 62/285
2007/0163295 A1 * 7/2007 Martin ..... F24F 1/08 62/507
2010/0307168 A1 * 12/2010 Kohl ..... F25B 21/02 62/3.6
2012/0218731 A1 * 8/2012 Suzuki ..... H05K 5/0247 361/807
2013/0255298 A1 * 10/2013 Amano ..... F25B 29/003 62/186
2014/0332182 A1 * 11/2014 Taras ..... H01L 23/36 165/80.3
2015/0204528 A1 * 7/2015 Zeng ..... H05B 33/0803 362/363

* cited by examiner

*Primary Examiner* — Thor Campbell
(74) *Attorney, Agent, or Firm* — Global IP Counselors

(57) ABSTRACT

A heat source unit of a refrigerating apparatus includes a heat exchanger, a blower, an electrical component, a rectifying member, and a casing. The casing houses the heat exchanger, blower, electrical component, and rectifying member. The casing has a vent that vents air upward. The electrical component controls driving of an actuator, and includes a heat-generating part and a heat sink. The heat sink is installed on the heat-generating part, and has a heat-radiating fin. The rectifying member extends along a vertical direction, and covers the heat-radiating fin, and rectifies flow of air. An air inlet is formed on a lower part, and an air outlet on an upper part of the rectifying member. A first air flow path is formed inside the rectifying member. An air flow generated by the blower passes through the first air flow path. The heat-radiating fin is positioned in the first air flow path.

5 Claims, 13 Drawing Sheets

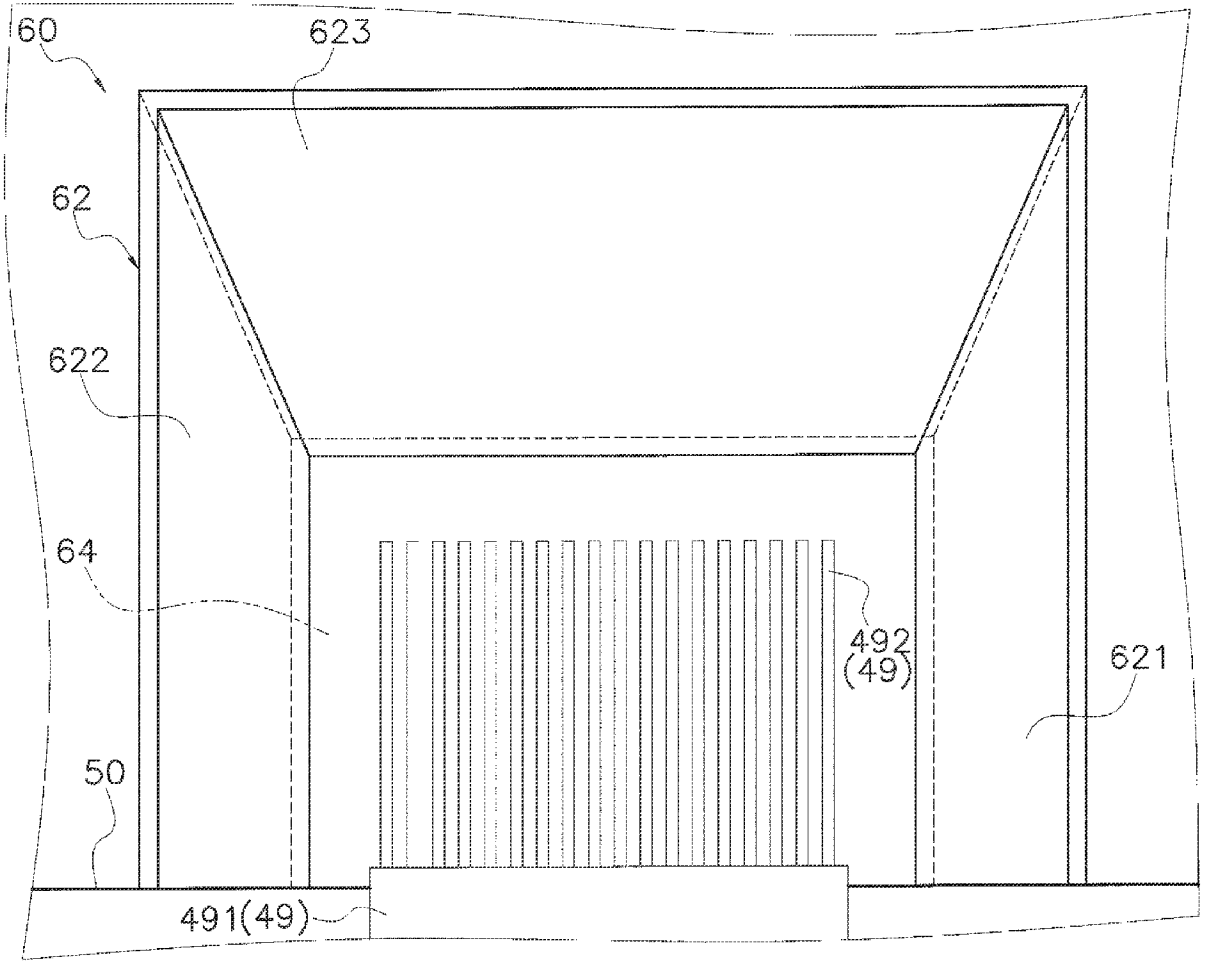
FIG. 11
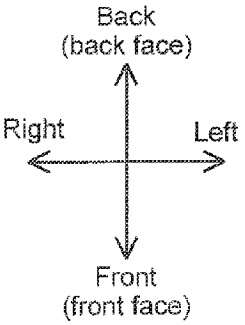

HEAT SOURCE UNIT OF REFRIGERATING APPARATUS

BACKGROUND OF THE INVENTION

1. Field of the Invention

The present invention relates to a heat source unit of a refrigerating apparatus.

2. Background Art

There is a conventional method of cooling a heat sink of an electrical component with an air flow generated by a blower in a heat source unit of a refrigerating apparatus comprising a blower and an electrical component.

SUMMARY

In a heat source unit as described above, the air flow sometimes may not stably pass by the periphery of the heat sink, and in such case it is imagined that the performance of the heat sink may degrade. The heat source unit according to the present invention therefore comprises a rectifying member for covering the heat-radiating fin of the heat sink.

Specifically, a heat source unit of a refrigerating apparatus according to a first aspect comprises a heat exchanger, a blower, an electrical component, a rectifying member, and a casing. The electrical component controls driving of an actuator. The rectifying member rectifies flow of air. The casing houses the heat exchanger, blower, electrical component, and rectifying member. A vent for venting air upward is formed on the casing. The electrical component includes a heat-generating part and a heat sink. The heat sink is installed on the heat-generating part. The heat sink has a heat-radiating fin. The rectifying member is a member that covers the heat-radiating fin. The rectifying member extends along the vertical direction. An inlet for air is formed on a lower part of the rectifying member. An outlet for air is formed on an upper part of the rectifying member. A first air flow path is formed inside the rectifying member. An air flow generated by the blower passes through the first air flow path. The heat-radiating fin is positioned inside the first air flow path.

The air flow thereby stably passes by the periphery of the heat-radiating fin during operation. As a result, heat exchange between the heat sink and the air flow is stably accomplished, and degradation of performance of the heat sink is suppressed.

A heat source unit of a refrigerating apparatus according to a second aspect is the heat source unit of a refrigerating apparatus according to the first aspect, wherein the heat-radiating fin extends along the vertical direction.

In the heat source unit of a refrigerating apparatus according to the second aspect, the air flow stably passes by the periphery of the heat-radiating fin even when conditions are such that it would be difficult for the air flow to stably pass by the periphery of the heat-radiating fin.

A heat source unit of a refrigerating apparatus according to a third aspect is the heat source unit of a refrigerating apparatus according to the first aspect, wherein the cross-sectional area of the inlet and/or outlet of the rectifying member is larger than the other portion thereof.

The air flow thereby stably flows into the first air flow path. As a result, the flow speed of the air passing by the periphery of the heat-radiating fin is stably assured. The air flow thereby more stably passes by the periphery of the heat-radiating fin, and heat exchange between the heat sink and the air flow is more stably accomplished.

A heat source unit of a refrigerating apparatus according to a fourth aspect is the heat source unit of a refrigerating apparatus according to the first aspect, further comprising a partitioning plate. The partitioning plate is placed inside the casing. The partitioning plate partitions a space inside the casing into a first space and a second space. The blower is positioned in the first space. The electrical component is fixed to the partitioning plate. The heat-generating part is positioned in the second space. The heat-radiating fin is positioned in the first space. The rectifying member is placed on a plate face of the partitioning plate on a side facing the first space.

The air flow thereby stably passes by the periphery of the heat-radiating fin during operation, and heat exchange between the heat sink and the air flow is stably accomplished.

A heat source unit of a refrigerating apparatus according to a fifth aspect is the heat source unit of a refrigerating apparatus according to the fourth aspect, wherein the heat exchanger has a first side face part, a second side face part, a third side face part, and a fourth side face part. The second side face part is adjacent to the first side face part. The third side face part is opposite the first side face part and adjacent to the second side face part. The fourth side face part is opposite the second side face part and adjacent to the third side face part. The first side face part faces a first side face of the casing. The fourth side face part faces a second side face of the casing. An end part of the first side face part configures one end of the heat exchanger. An end part of the fourth side face part configures the other end of the heat exchanger. The second space is positioned in a corner formed by the first side face and the second side face. The partitioning plate is positioned between the end part of the first side face part and the end part of the fourth side face part.

In the heat source unit of a refrigerating apparatus according to the fifth aspect, the air flow stably passes by the periphery of the heat-radiating fin even when conditions are such that it would be difficult for the air flow to stably pass by the periphery of the heat-radiating fin.

BRIEF DESCRIPTION OF THE DRAWINGS

FIG. 11 is a top view of the rectifying member.

DETAILED DESCRIPTION OF EMBODIMENT(S)

A heat source unit 20 according to one embodiment of the present invention is described below. The embodiment below is a specific example of the present invention and is not a limitation of the technical scope of the present invention. Suitable modifications may be made within a scope not deviating from the gist of the invention. In the embodiment below, the directions "up," "down," "front (front face)," "back (back face)," "left," and "right" signify the directions illustrated in FIGS. 2 to 13. These directions are directions based on a main face 50*a* in the condition of placement of a partitioning plate 50 (to be described).

(1) Configuration of the Air-Conditioning Apparatus 100

Figure 1:
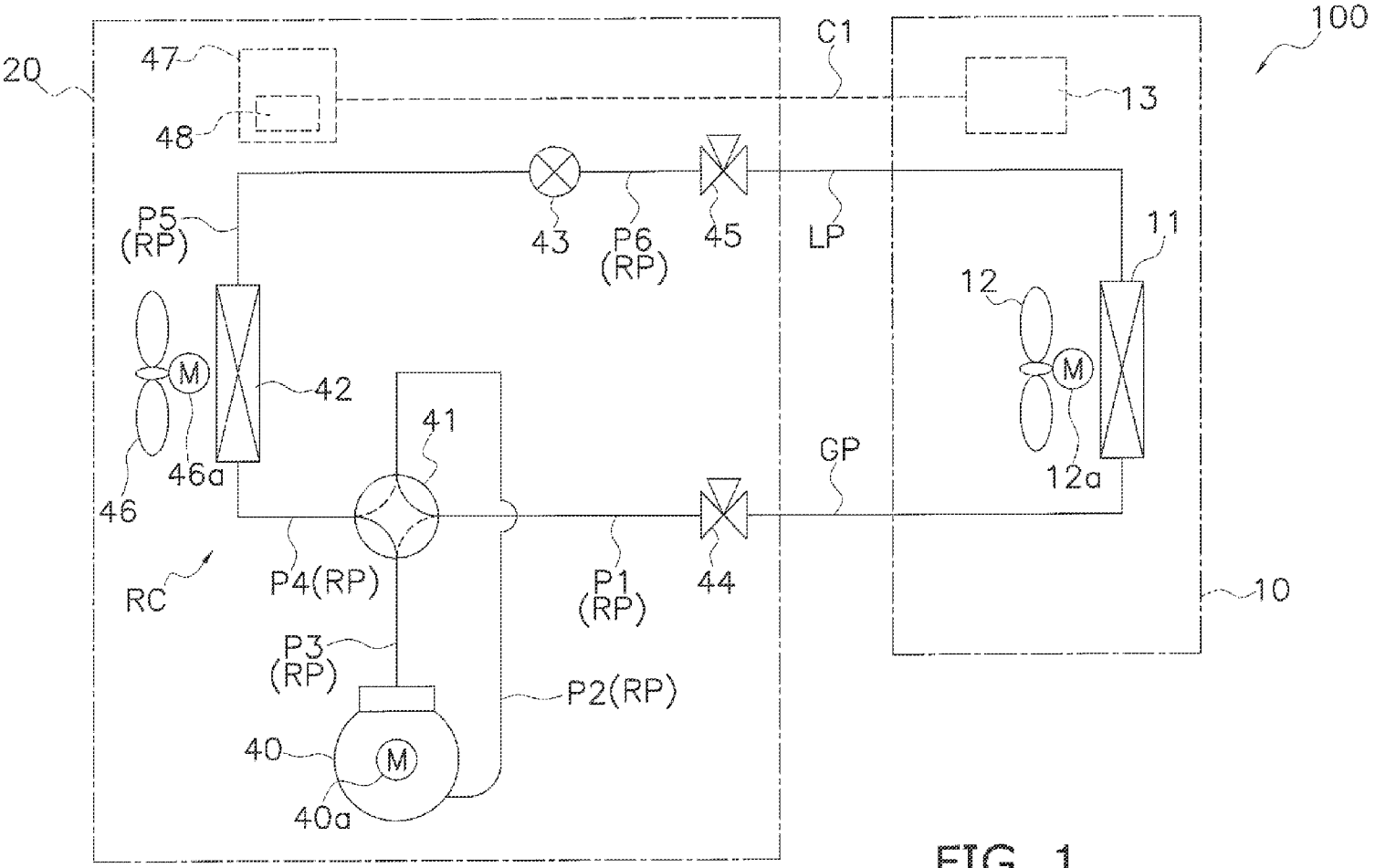
FIG. 1 is a schematic diagram of an air-conditioning apparatus including a heat source unit according to one embodiment of the present invention.

FIG. 1 is a schematic diagram of an air-conditioning apparatus 100 including a heat source unit 20 according to one embodiment of the present invention.

The air-conditioning apparatus 100 is an apparatus for performing a cooling operation or a warming operation to realize air conditioning of an object space. Specifically, the air-conditioning apparatus 100 performs a vapor compression-type refrigeration cycle. In the air-conditioning apparatus 100, a refrigerant circuit RC is configured mainly by connection of a utilization unit 10 and a heat source unit 20. The utilization unit 10 and the heat source unit 20 are connected by way of a liquid refrigerant connection pipe LP and a gas refrigerant connection pipe GP.

Utilization Unit 10

The utilization unit 10 is placed indoors. The utilization unit 10 mainly has a utilization-side heat exchanger 11, a utilization unit blower 12, and a utilization unit controller 13.

The utilization-side heat exchanger 11 is a heat exchanger that functions as an evaporator of refrigerant during the cooling operation and functions as a condenser or a radiator of refrigerant during the warming operation. A liquid side of the utilization-side heat exchanger 11 is connected to the liquid refrigerant connection pipe LP, and a gas side of the utilization-side heat exchanger 11 is connected to a gas refrigerant connection pipe GP.

The utilization unit blower 12 is a blower for generating an air flow that flows into the utilization unit 10 from outside the utilization unit 10, passes through the utilization-side heat exchanger 11, and then flows out of the utilization unit 10. The utilization unit blower 12 is connected to an output shaft of a utilization unit blower motor 12*a*, and drives in unison with operation of the utilization unit blower motor 12*a*.

The utilization unit controller 13 is a microcomputer including a CPU, memory, and/or the like. The utilization unit controller 13 is connected with a heat source unit controller 47 by way of a communication cable C1, and signals are mutually exchanged in accordance with the situation. The utilization unit 10 also exchanges signals with a remote controller (not illustrated).

Heat Source Unit 20

The heat source unit 20 is placed outdoors, in a basement, and/or the like. The heat source unit 20 mainly has refrigerant piping RP, a compressor 40, a four-way switching valve 41, a heat source-side heat exchanger 42, an expansion valve 43, a gas-side closing valve 44, a liquid-side closing valve 45, a heat source unit blower 46, and the heat source unit controller 47, and these machines and devices are housed inside a casing 30 (to be described).

The refrigerant piping RP placed in the heat source unit 20 mainly include first refrigerant piping P1, second refrigerant piping P2, third refrigerant piping P3, fourth refrigerant piping P4, fifth refrigerant piping P5, and sixth refrigerant piping P6. One end of the first refrigerant piping P1 is connected to the gas-side closing valve 44, and the other end is connected to the four-way switching valve 41. One end of the second refrigerant piping P2 is connected to the four-way switching valve 41, and the other end is connected to an intake port of the compressor 40. One end of the third refrigerant piping P3 is connected to a discharge port of the compressor 40, and the other end is connected to the four-way switching valve 41. One end of the fourth refrigerant piping P4 is connected to the four-way switching valve 41, and the other end is connected to the heat source-side heat exchanger 42. One end of the fifth refrigerant piping P5 is connected to the heat source-side heat exchanger 42, and the other end is connected to the expansion valve 43. One end of the sixth refrigerant piping P6 is connected to the expansion valve 43, and the other end is connected to the liquid-side closing valve 45.

The compressor 40 is a machine for compressing a refrigerant. The compressor 40 drives in unison with operation of a compressor motor 40*a*. The compressor motor 40*a* is a motor of a type in which the frequency (rotation rate) is controllable by an inverter. The compressor 40 is configured so that an operating capacity can be controlled by varying a frequency (rotation rate).

The four-way switching valve 41 is a switching valve for switching the direction of flow of the refrigerant in the refrigerant circuit RC. In the present embodiment, the four-way switching valve 41 is a four-way valve connected to the first refrigerant piping P1, second refrigerant piping P2, third refrigerant piping P3, and fourth refrigerant piping P4. The four-way switching valve 41 connects the first refrigerant piping P1 and the second refrigerant piping P2 and connects the third refrigerant piping P3 and the fourth refrigerant piping P4 during the cooling operation (see the solid line of the four-way switching valve 41 in FIG. 1). The four-way switching valve 41 connects the first refrigerant piping P1 and the third refrigerant piping P3 and connects the second refrigerant piping P2 and the fourth refrigerant piping P4 during the warming operation (see the broken line of the four-way switching valve 41 in FIG. 1).

The heat source-side heat exchanger 42 is a heat exchanger that functions as a condenser or a radiator of refrigerant during the cooling operation and functions as an evaporator of refrigerant during the warming operation. A gas side of the heat source-side heat exchanger 42 is connected to the fourth refrigerant piping P4, and a liquid side is connected to the fifth refrigerant piping P5. The configuration of the heat source-side heat exchanger 42 is to be described.

The expansion valve 43 is a valve for depressurizing a high-pressure refrigerant. The expansion valve 43 depressurizes the high-pressure refrigerant condensed or radiated in the heat source-side heat exchanger 42. The expansion valve 43 depressurizes the high-pressure refrigerant condensed or radiated in the utilization-side heat exchanger 11 during the warming operation.

The gas-side closing valve 44 and the liquid-side closing valve 45 are manually-operated valves that are closed during pump down, or the like. One end of the gas-side closing valve 44 is connected to the gas refrigerant connection pipe GP, and the other end is connected to the first refrigerant piping P1. One end of the liquid-side closing valve 45 is connected to the liquid refrigerant connection pipe LP, and the other end is connected to the sixth refrigerant piping P6.

The heat source unit blower 46 is, for example, a propeller fan or other blower. The heat source unit blower 46 generates an air flow that flows into the casing 30 from outside the casing 30, passes through the heat source-side heat exchanger 42, and then flows out of the casing 30 by way of a vent 321. The heat source unit blower 46 is connected to an output shaft of a heat source unit blower motor 46*a*, and drives in unison with operation of the heat source unit blower motor 46*a*.

The heat source unit controller 47 (equivalent to "electrical component" of claims) controls the operation of the compressor motor 40*a* and of other actuators included in the heat source unit 20. The heat source unit controller 47 is a unit having a microcomputer including a CPU, memory, and/or the like, and/or various other electrical components such as an inverter. The heat source unit controller 47 is mounted on a base plate 47*a*. A heat-generating part such as a power element that generates heat by electrical conduction is included in the electrical components included in the heat source unit controller 47. A heat sink 49 is provided on the base plate 47*a* for cooling this heat-generating part. The heat sink 49 is a cooling member for cooling the heat-generating part. The heat sink 49 shall be described.

(2) Details of the Heat Source Unit 20 and Parts Disposed Inside the Heat Source Unit 20

Figure 2:
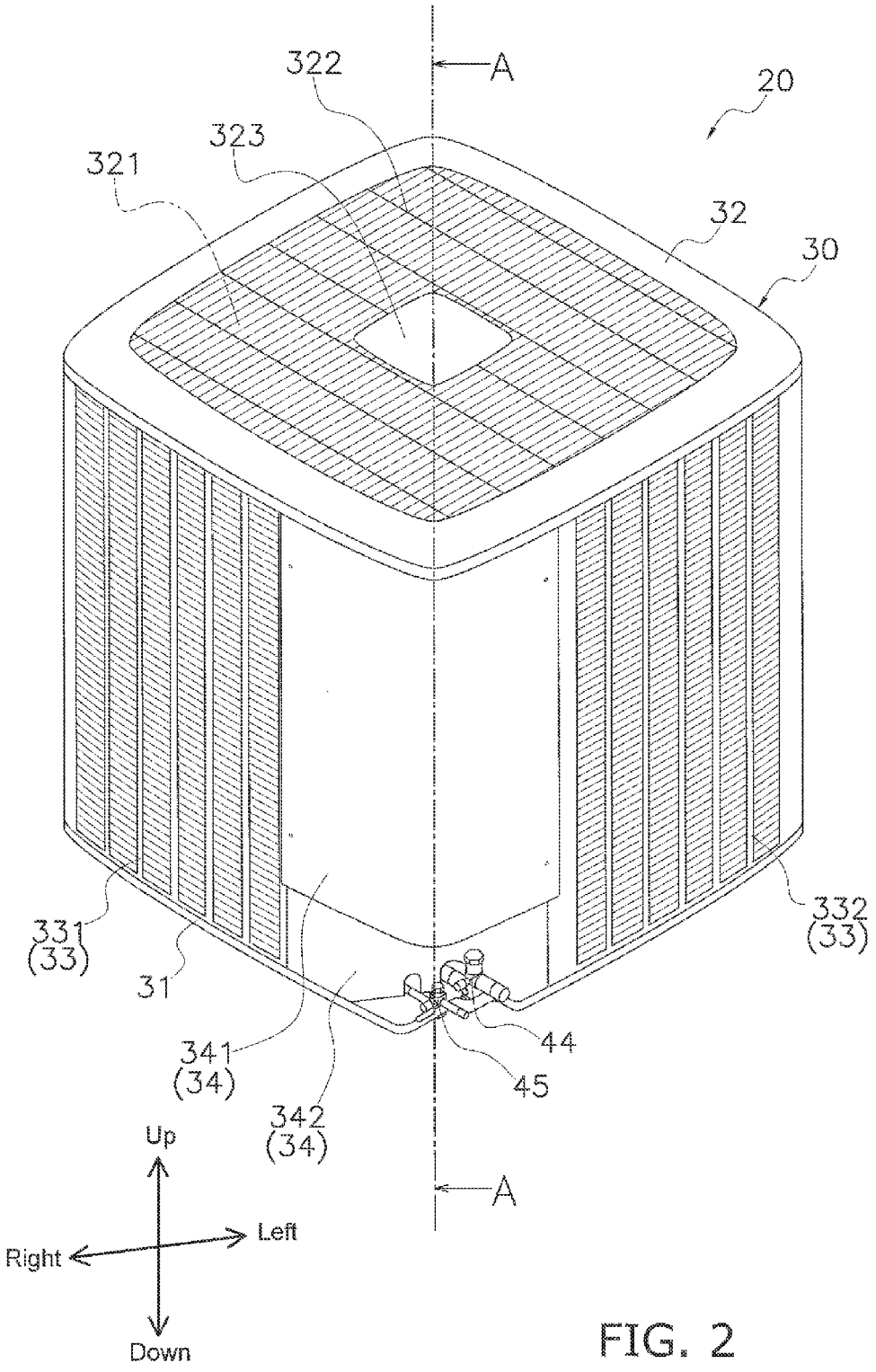
FIG. 2 is an external perspective view of the heat source unit according to one embodiment of the present invention.
Figure 3:
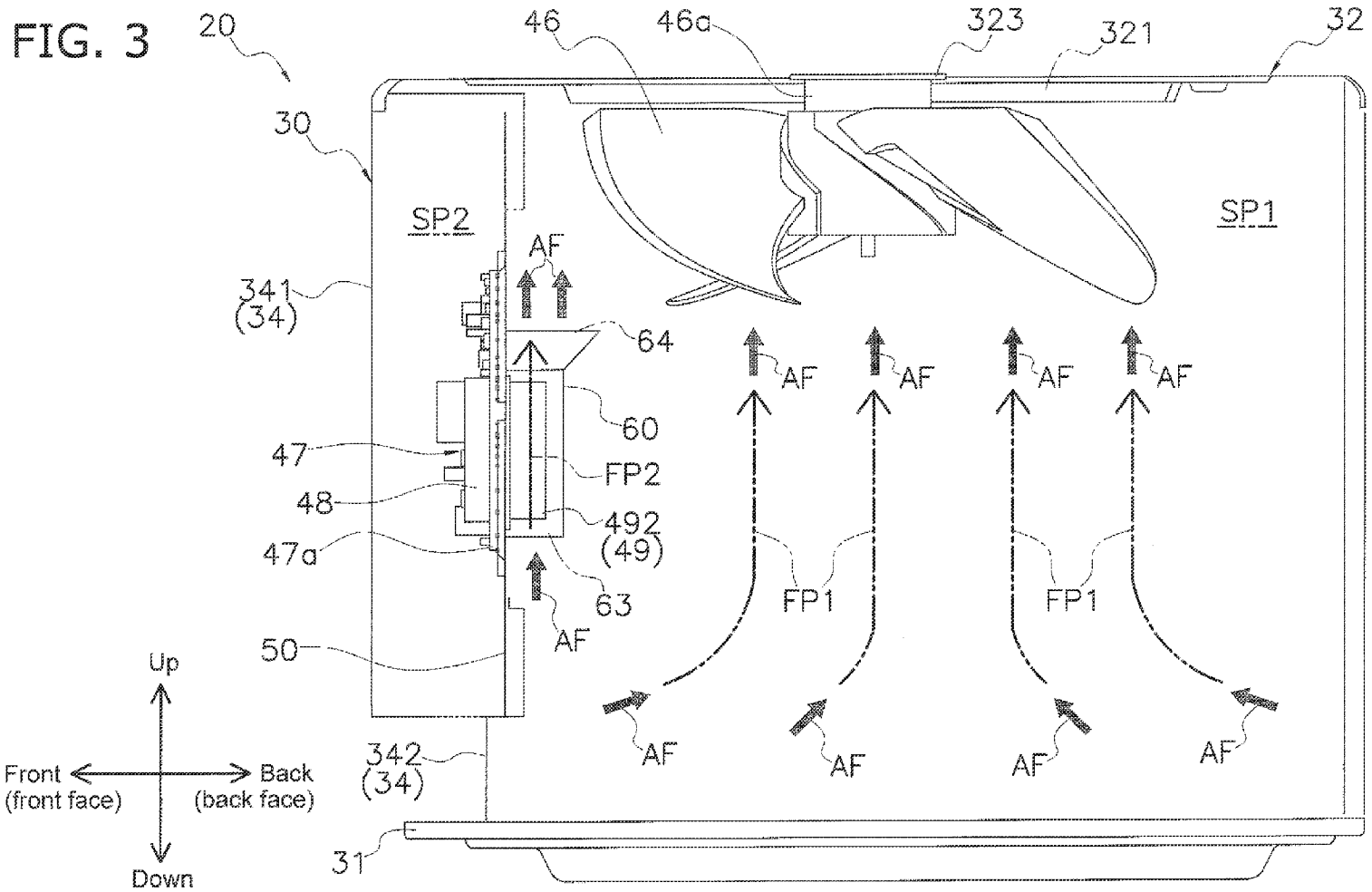
FIG. 3 is a sectional view along A-A in FIG. 2 (some machines and devices housed inside the casing are not illustrated).
Figure 4:
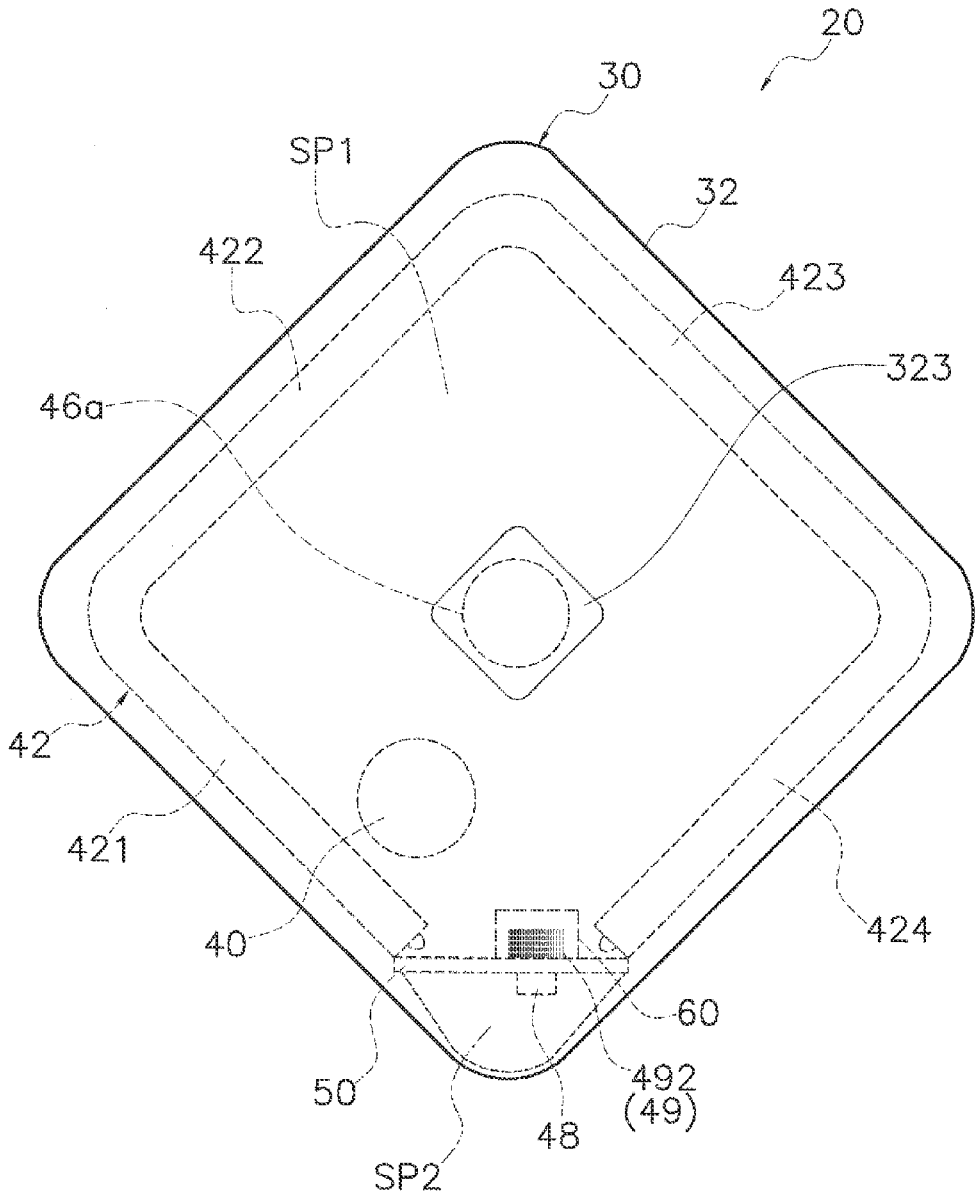
FIG. 4 is a diagram typically illustrating the heat source unit viewed from above.
Figure 4:
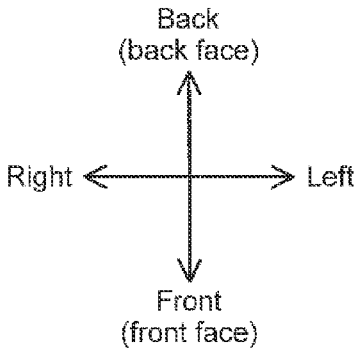

The heat source unit 20 and various parts disposed inside the heat source unit 20 shall now be described in detail. FIG. 2 is an external perspective view of the heat source unit 20 according to one embodiment of the present invention. FIG. 3 is a sectional view along A-A in FIG. 2 (some machines and devices housed inside the casing 30 are not illustrated). FIG. 4 is a diagram typically illustrating the heat source unit 20 viewed from above.

(Casing 30)

The outline of the heat source unit 20 is configured from a roughly parallelepiped-form casing 30, and various machines and devices are housed inside the casing 30. A partitioning plate 50 and a rectifying member 60 are placed inside the casing 30. The partitioning plate 50 and the rectifying member 60 are to be described. A machine compartment SP1 and an electrical components compartment SP2 are formed inside the casing 30. The machine compartment SP1 and the electrical components compartment SP2 are to be described. The casing 30 mainly has a floor plate 31, a ceiling plate 32, a side face grill 33, and a corner cover 34.

The floor plate 31 is a roughly square plate-form member configuring a bottom face portion of the casing 30. The partitioning plate 50 is placed on top of the floor plate 31. A plurality of ribs (not illustrated) is formed on the floor plate 31 for the purpose of forming drainage channels for drain water, providing strength to the floor plate 31, and/or other purposes.

The ceiling plate 32 is a roughly square plate-form member configuring a top face portion of the casing 30. The ceiling plate 32 has a large opening functioning as a vent 321 for air. The reason why the vent 321 is formed in the ceiling plate 32 is because the direction of venting of air is upward in the heat source unit 20. That is, the heat source unit 20 is configured so as to discharge air upward by way of the vent 321 after having taken air into the casing 30 from four side faces during operation. A lattice-form member 322 is provided on the vent 321 for the purpose of preventing articles from falling in, or the like, and configures a portion of the ceiling plate 32. A plate-form motor installation part 323 is provided in the center portion of the ceiling plate 32, and configures a portion of the ceiling plate 32. The heat source unit blower motor 46*a* is fixed on the lower face side of the motor installation part 323. That is, the heat source unit blower motor 46*a* is fixed to the ceiling plate 32.

The side face grill 33 is a lattice-form member configuring four side faces of the casing 30. The side face grill 33 includes a first side face grill 331 and a second side face grill 332. The first side face grill 331 configures one side face among the four side faces of the casing 30, and the second side face grill 332 configures another one side face. More specifically, the second side face grill 332 configures a side face adjacent to the side face configured by the first side face grill 331.

The corner cover 34 is a plate-form member covering a corner portion formed by the side face configured by the first side face grill 331 and the side face configured by the second side face grill 332. In other words, the corner cover 34 can be considered as a member connecting one end of the first side face grill 331 and one end of the second side face grill 332. The corner cover 34 is fixed by screws to the first side face grill 331 and the second side face grill 332. The corner cover 34 includes a first corner cover 341 and a second corner cover 342.

The first corner cover 341 is a plate-form member having a roughly L shape or a roughly V shape in plan view. The first corner cover 341 shields the electrical components compartment SP2 from the outside. The second corner cover 342 is a plate-form member placed further below from the first corner cover 341. The second corner cover 342 is placed on the floor plate 31. The second corner cover 342 shields the machine compartment SP1 from the outside below the electrical components compartment SP2. An opening exposing the gas-side closing valve 44 and the liquid-side closing valve 45 is formed on the second corner cover 342.

(Heat Source-Side Heat Exchanger 42)

Figure 5:
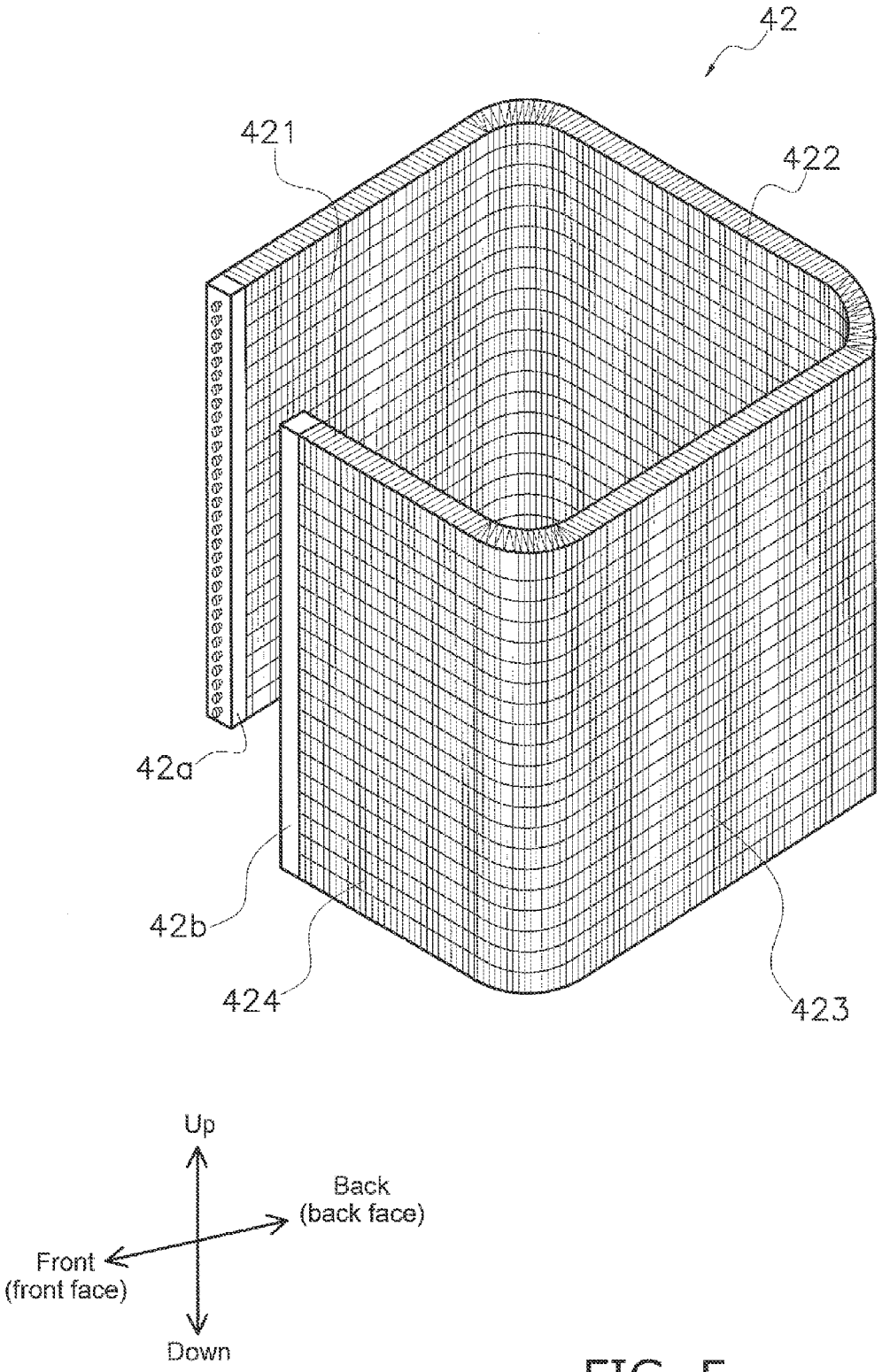
FIG. 5 is an external perspective view of the heat source-side heat exchanger.

FIG. 5 is an external perspective view of the heat source-side heat exchanger 42. The heat source-side heat exchanger 42 is a fin-and-tube heat exchanger including a plurality of heat-transmitting tubes and a plurality of fins. The heat source-side heat exchanger 42 has four side face parts facing the side faces of the casing 30, and two tube plates. Specifically, the heat source-side heat exchanger 42 has a first side face part 421, a second side face part 422, a third side face part 423, a fourth side face part 424, a first tube plate 42*a*, and a second tube plate 42*b*.

The first side face part 421 faces the side face configured by the first side face grill 331. The second side face part 422 faces a side face adjacent to the side face configured by the first side face grill 331. That is, the second side face part 422 is adjacent to the first side face part 421. The third side face part 423 faces a side face opposite the side face faced by the first side face part 421 and adjacent to the side face faced by the second side face part 422. That is, the third side face part 423 is opposite the first side face part 421 and adjacent to the second side face part 422. The fourth side face part 424 faces the side face configured by the second side face grill 332. The fourth side face part 424 also faces a side face opposite the side face faced by the second side face part 422 and adjacent to the side face faced by the third side face part 423. That is, the fourth side face part 424 is opposite the second side face part 422 and adjacent to the third side face part 423. The fourth side face part 424 is not adjacent to the first side face part 421.

The first tube plate 42*a* is fixed to an end part of the first side face part 421. The second tube plate 42*b* is fixed to an end part of the fourth side face part 424. Screw holes (not illustrated) for fixing a second plate 52 (to be described) are formed on the first tube plate 42*a* and the second tube plate 42*b*.

In the heat source-side heat exchanger 42, as illustrated in FIGS. 4 and 5, the end of the first side face part 421 (that is, the first tube plate 42*a*) configures one end of the heat source-side heat exchanger 42, and the end of the fourth side face part 424 (that is, the second tube plate 42*b*) configures the other end of the heat source-side heat exchanger 42. A space is present between the end part of the first side face part 421 and the end part of the fourth side face part 424, and the partitioning plate 50 is placed in that space.

(Partitioning Plate 50 and Base Plate 47*a*)

Figure 6:
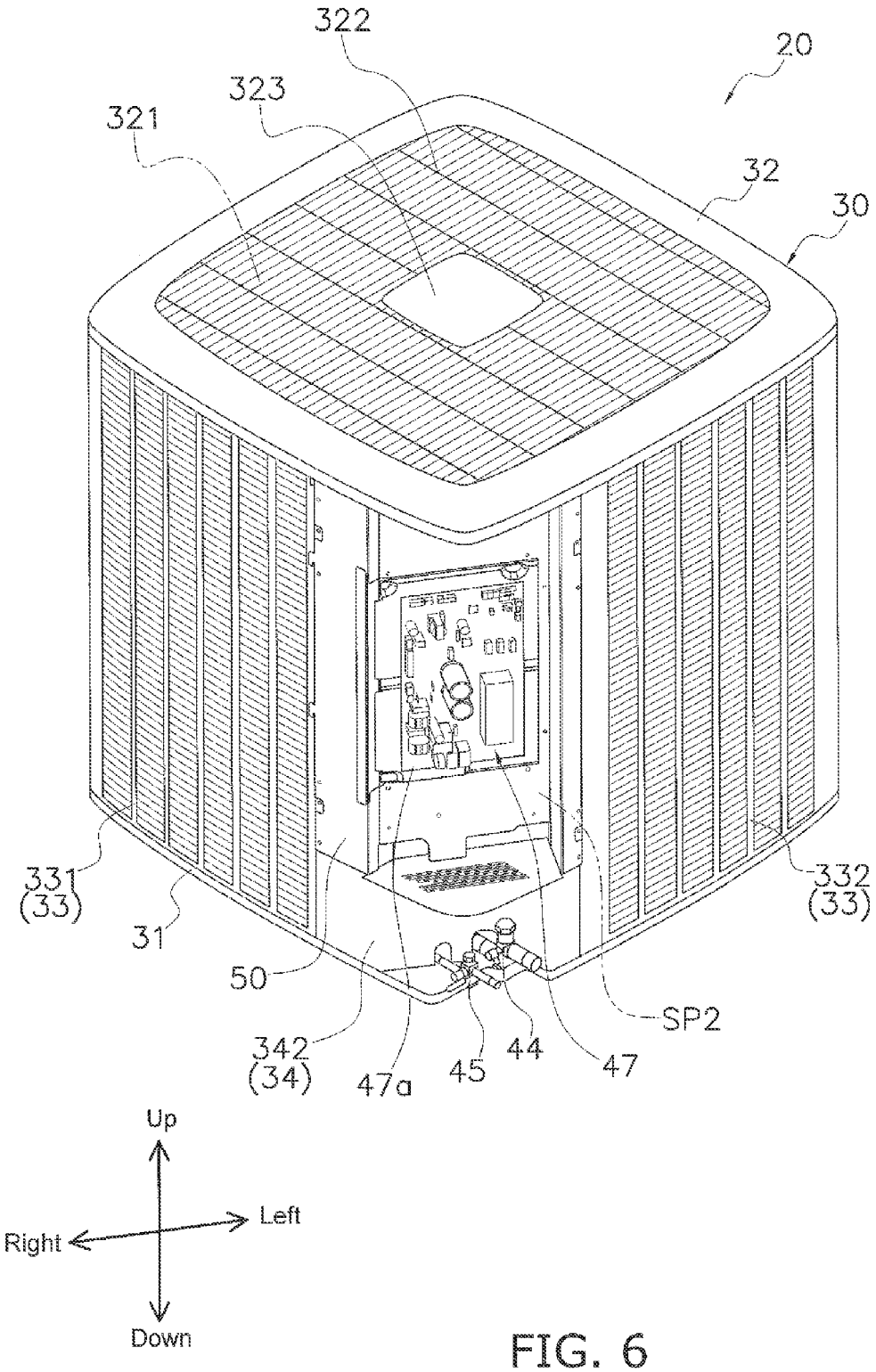
FIG. 6 is an external perspective view of the heat source unit in a condition having removed the corner cover.
Figure 7:
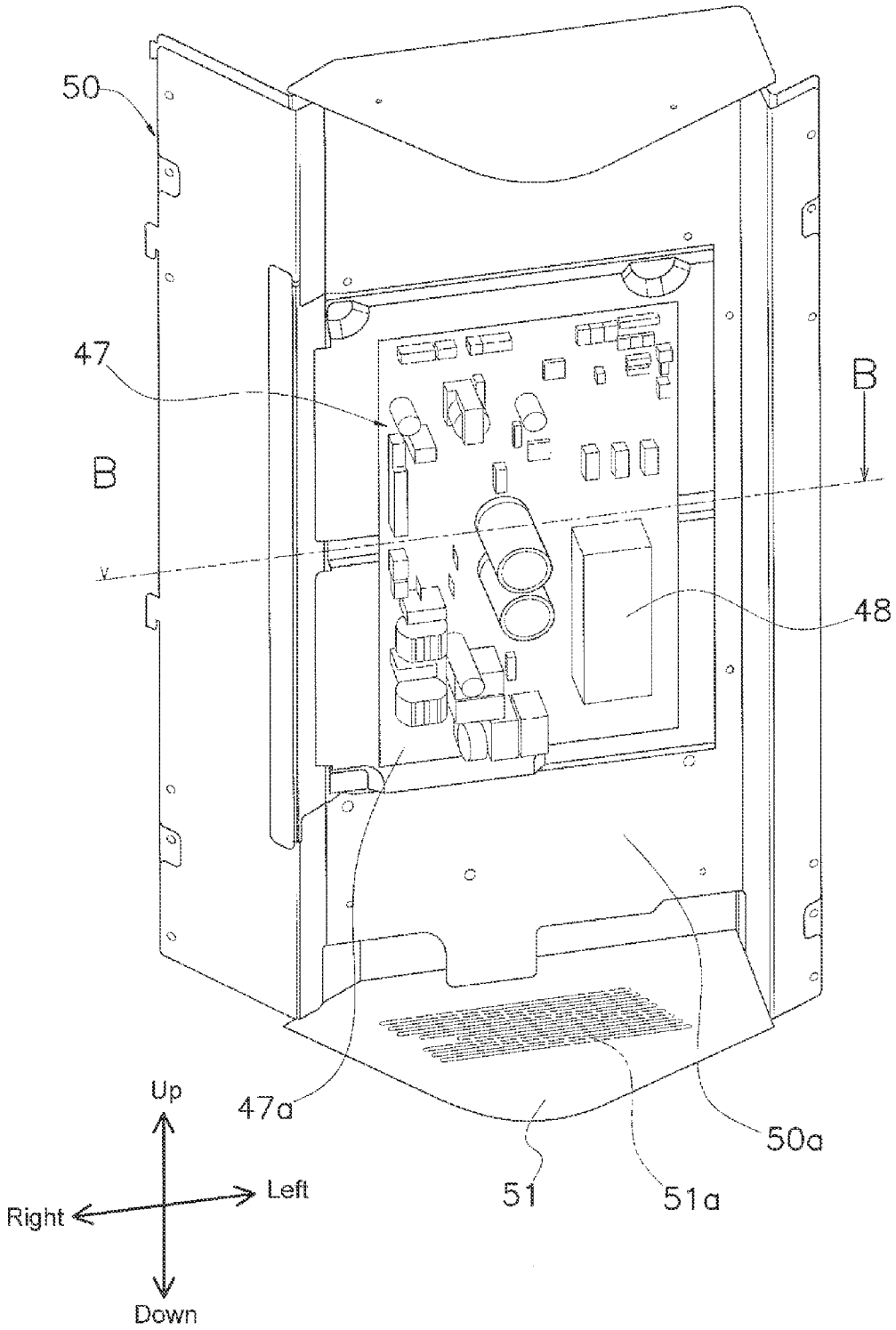
FIG. 7 is an external view of the partitioning plate in a state having the base plate fixed.
Figure 8:
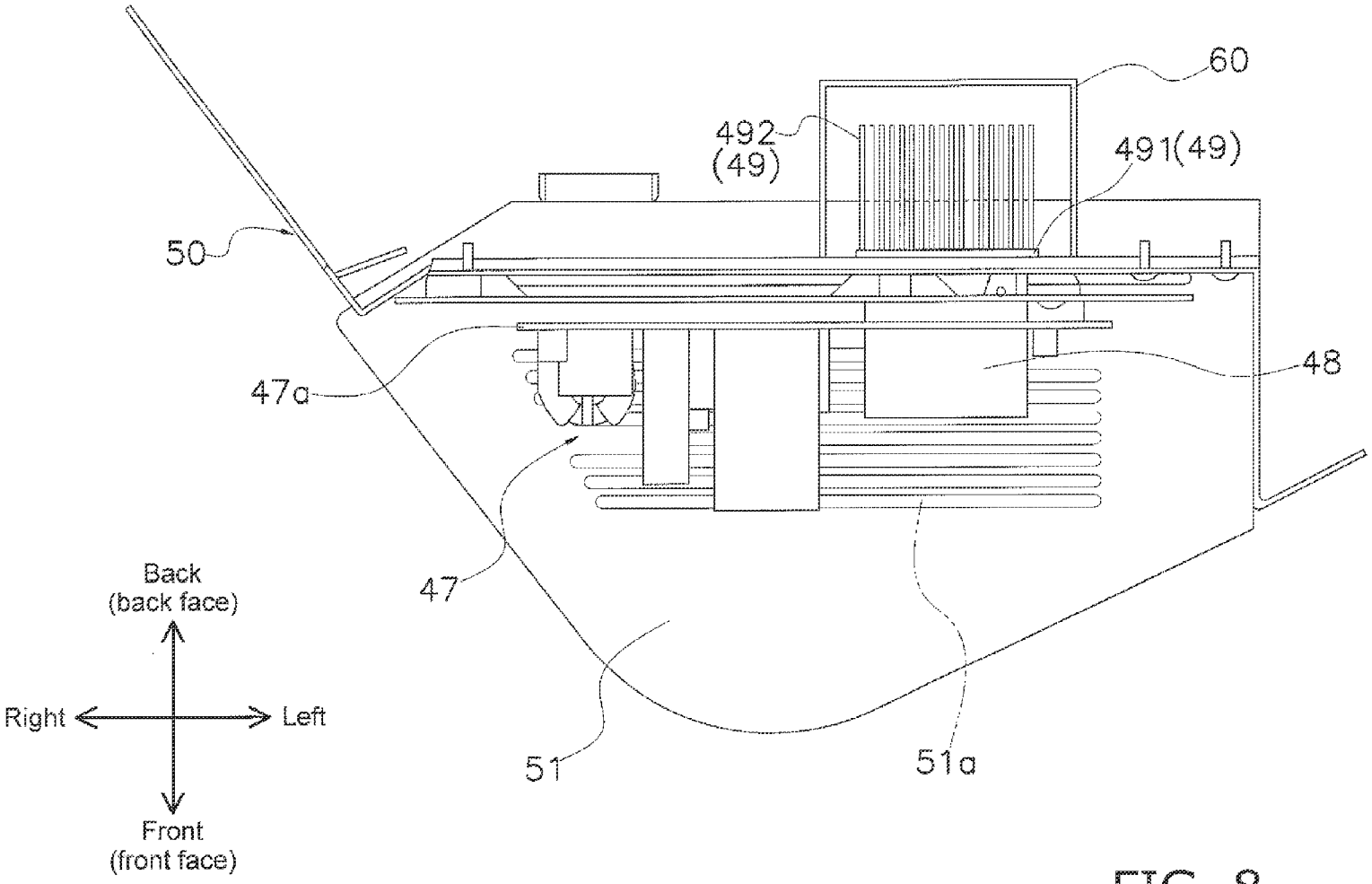
FIG. 8 is a sectional view along B-B in FIG. 7.

FIG. 6 is an external perspective view of the heat source unit 20 in a condition having removed the first corner cover 341. FIG. 7 is an external view of the partitioning plate 50 in a condition having the base plate 47*a* fixed. FIG. 8 is a sectional view along B-B in FIG. 7.

The heat source unit 20 has a partitioning plate 50 extending along the vertical direction inside the casing 30. "Extending along the vertical direction" includes not only the case of extending strictly in the vertical direction, but also the case of being slightly tilted toward the vertical direction. Specifically, it is understood as that the partitioning plate 50 extends along the vertical direction if the angle between the partitioning plate 50 and the vertical line is 0° to within 30° when viewed from the side.

The partitioning plate 50 is a plate-form member that partitions the space inside the casing 30 into a machine compartment SP1 (to be described) and an electrical components compartment SP2 (to be described). In the heat source unit 20 as illustrated in FIG. 6, the partitioning plate 50 and the base plate 47*a* fixed to the partitioning plate 50 are exposed when the first corner cover 341 is removed. The partitioning plate 50 is placed between the end part of the first side face part 421 and the end part of the fourth side face part 424 (see FIG. 4). A plurality of screw holes are formed on the partitioning plate 50. The partitioning plate 50 is fixed by screws through the plurality of screw holes to the first tube plate 42*a*, second tube plate 42*b*, ceiling plate 32, and the like.

The base plate 47*a* on which the heat source unit controller 47 is mounted is fixed in the center portion of a main face 50*a* of the partitioning plate 50. The heat-generating part is disposed on a front face side of the base plate 47*a*. A heat-radiating fins 492 (to be described) of the heat sink 49 is disposed on a back face side of the base plate 47*a*. An opening (not illustrated) for allowing the heat-radiating fins 492 to project toward the side of the machine compartment SP1 is formed on the partitioning plate 50, and the heat-radiating fins 492 projects toward the side of the machine compartment SP1 through that opening.

A bottom part 51 is provided on a lower end of the partitioning plate 50. The bottom part 51 is a plate-form member extending along a horizontal direction. The bottom part 51, together with the first corner cover 341, partitions the electrical components compartment SP2 and the external space. A ventilation port 51*a* for taking in air from outside is formed on the bottom part 51. Specifically, the ventilation port 51*a* is a plurality of slits extending along the left-to-right direction. In the heat source unit 20, air from outside flows into the electrical components compartment SP2 through the ventilation port 51*a*, and cools the electrical components included in the heat source unit controller 47.

(Heat Sink 49)

The heat sink 49 is configured, for example, from aluminum or another metal. The heat sink 49 is fixed to the base plate 47*a*. The heat sink 49 is installed on the heat-generating part and cools the heat-generating part. Specifically, the heat sink 49 has a main body part 491 and heat-radiating fins 492. The heat sink 49 cools the heat-generating part by absorbing heat from the heat-generating part and radiating heat by way of the heat-radiating fins 492.

The main body part 491 is a roughly rectangular plate-form member. A surface on the front face side of the main body part 491 thermally contacts the heat-generating part. The heat-radiating fins 492 are a plurality of fins extending along the top-to-bottom direction (vertical direction) on a surface on the back face side of the main body part 491. The heat-radiating fins 492 are disposed so as to be arrayed in the left-to-right direction with a prescribed spacing. The heat-radiating fins 492 are positioned within a cool air flow path FP2 to be described.

(Machine Compartment SP1 and Electrical Components Compartment SP2)

Two spaces are formed by placement of the partitioning plate 50 inside the casing 30. Specifically, the space formed on the back face side of the partitioning plate 50 is the machine compartment SP1 (equivalent to "first space" in claims). The space formed on the front face side of the partitioning plate 50 is the electrical components compartment SP2 (equivalent to "second space" in claims).

The machine compartment SP1 is a space occupying the larger portion inside of the casing 30 as illustrated in FIG. 4. Specifically, the machine compartment SP1 is surrounded by the heat source-side heat exchanger 42 (that is, the first side face part 421, second side face part 422, third side face part 423, and fourth side face part 424) and the partitioning plate 50. The compressor 40, heat source unit blower 46 or other actuator, refrigerant piping RP, and/or the like, are disposed in the machine compartment SP1. The heat-radiating fins 492 of the heat sink 49 also are disposed in the machine compartment SP1.

The electrical components compartment SP2 is a space formed in the corner formed on the front face side among the four corners of the casing 30 as illustrated in FIG. 4. In other words, the electrical components compartment SP2 is formed in the corner portion formed by the side face configured by the first side face grill 331 and the side face configured by the second side face grill 332. The electrical components compartment SP2 is surrounded by the first corner cover 341 and the partitioning plate 50. The heat source unit controller 47 including the heat-generating part is disposed in the electrical components compartment SP2.

(Rectifying Member 60)

Figure 9:
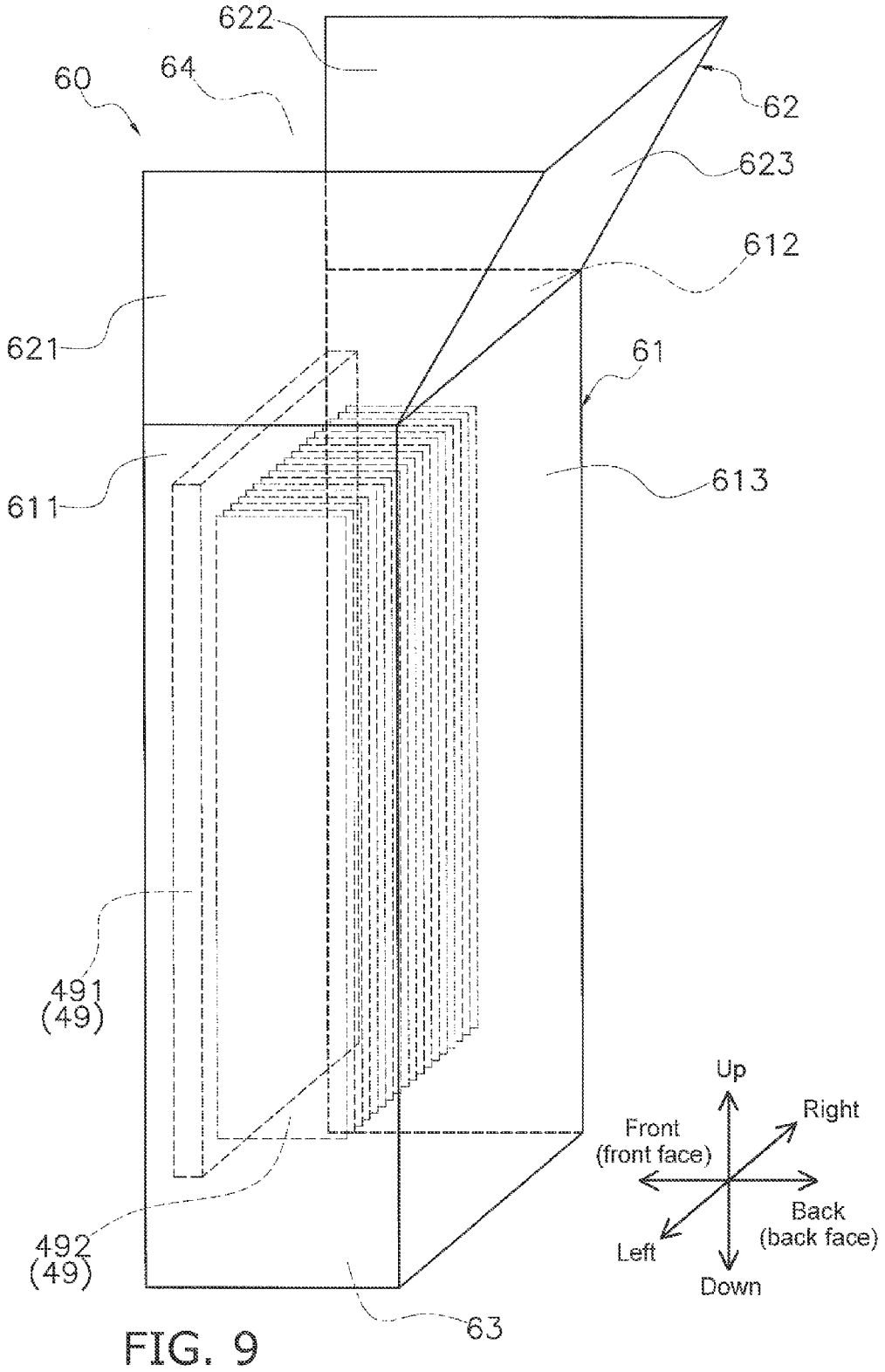
FIG. 9 is an external perspective view of the rectifying member.
Figure 10:
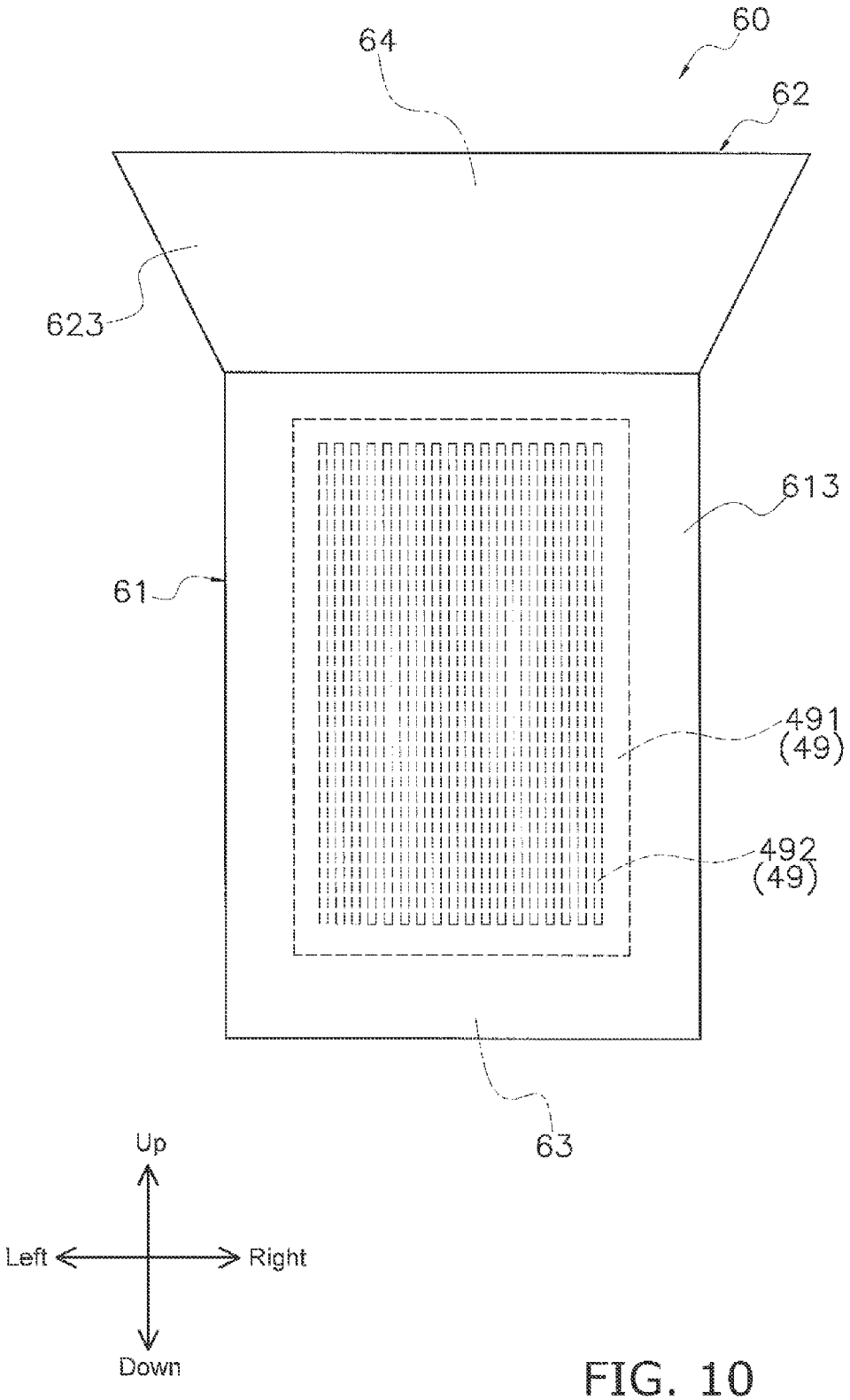
FIG. 10 is a back view of the rectifying member.

FIG. 9 is an external perspective view of the rectifying member 60. FIG. 10 is a back view of the rectifying member 60. FIG. 11 is a top view of the rectifying member 60.

The rectifying member 60 is placed in the machine compartment SP1 in order to rectify the flow of air inside the casing 30. Specifically, the rectifying member 60 is a member for forming a cool air flow path FP2 (to be described). The rectifying member 60 is a plate-form member configured, for example, with metal, synthetic resin, and/or the like. The rectifying member 60 is fixed on a plate face on the back face side (machine compartment SP1 side) of the partitioning plate 50.

The rectifying member 60 extends along the top-to-bottom direction (vertical direction), and covers the main body part 491 and heat-radiating fins 492 of the heat sink 49. The rectifying member 60 includes a base part 61 and an upper part 62.

The base part 61 has a first plane part 611, a second plane part 612, and a third plane part 613. The first plane part 611 configures a left end portion of the base part 61. The first plane part 611 has a roughly rectangular shape, and extends along the top-to-bottom direction (vertical direction). As illustrated in FIG. 9, the area of the first plane part 611 when viewed from the side face is larger than the area of the heat-radiating fins 492. The second plane part 612 configures a right end portion of the base part 61. The second plane part 612 has roughly the same shape as the first plane part 611, and is disposed so as to face opposite the first plane part 611. The third plane part 613 configures a back face portion of the base part 61. The third plane part 613 is disposed between the first plane part 611 and the second plane part 612. The third plane part 613 has a roughly rectangular shape, and extends along the top-to-bottom direction (vertical direction). The area of the third plane part 613 when viewed from the back is larger than the area of the main body part 491.

The upper part 62 specifically is provided above the base part 61. Specifically, the upper part 62 extends upward from the upper end of the base part 61. The upper part 62 includes an upper left side part 621, an upper right side part 622, and an upper back face part 623. The upper left side part 621 configures a left end portion of the upper part 62. The upper left side part 621 has a roughly trapezoidal shape in which the width (length in the front-to-back direction) widens going upward. Specifically, the length of the top edge of the upper left side part 621 is longer than the length of the bottom edge. The upper right side part 622 configures a right end portion of the upper part 62. The upper right side part 622 has roughly the same shape as the upper left side part 621, and is disposed so as to face opposite the upper left side part 621. The upper back face part 623 configures a back face portion of the upper part 62. The upper back face part 623 is disposed between the upper left side part 621 and the upper right side part 622. As illustrated in FIG. 10, the upper back face part 623 has a roughly trapezoidal shape in which the width (length in the left-to-right direction) widens going upward. Specifically, the length of the top edge of the upper back face part 623 is longer than the length of the bottom edge.

The rectifying member configured as above has an opening formed on a lower end portion, and that opening functions as an inlet 63 of the cool air flow path FP2. The rectifying member 60 also has an opening formed on an upper end portion, and that opening functions as an outlet 64 of the cool air flow path FP2. The area of the outlet 64 in plan view is larger than the area of the other portion of the rectifying member 60. That is, the cross-sectional area of the outlet 64 is larger than the cross-sectional area of the other portion of the rectifying member 60.

In the heat source unit 20, the cool air flow path FP2 is formed inside the machine compartment SP1 by placement of the rectifying member 60, and an air flow AF (to be described) flows on the cool air flow path FP2. In other words, in the heat source unit 20, the air flow flows stably in the periphery of the heat-radiating fins 492 by placement of the rectifying member 60 so as to cover the heat-radiating fins 492.

(Air Flow Path Formed in Machine Compartment SP1)

In the heat source unit 20, an air flow flowing into the casing 30 from outside the casing 30 and flowing out from the vent 321 is generated when the heat source unit blower 46 is driven. In the following description, the air flow flowing into the casing 30 through the side face grill 33 and passing through the heat source-side heat exchanger 42 is referred to as "air flow AF" (see the blackened arrows in FIG. 3).

In the heat source unit 20, a plurality of air flow paths on which the air flow AF passes is formed inside the machine compartment SP1. Specifically, a central air flow path FP1 and a cool air flow path FP2 (equivalent to "first air flow path" in claims) are formed in the machine compartment SP1 (see the double-dotted arrows in FIG. 3).

The central air flow path FP1 is a flow path on which the air flow AF goes toward the vent 321. The cool air flow path FP2 is a flow path formed for the purpose of having the air flow AF stably passes by the periphery of the heat-radiating fins 492. That is, the cool air flow path FP2 is a flow path on which the air flow for cooling the heat-generating part passes. Specifically, the cool air flow path FP2 is formed by being surrounded by the partitioning plate 50 and the rectifying member 60. In other words, the cool air flow path FP2 is formed inside the rectifying member 60. The area of the outlet 64 of the cool air flow path FP2 is larger than the other area in plan view (that is, when viewed from the direction of flow of the air flow AF).

(3) Flow of Air During Operation

The heat source unit blower 46 is driven and the air flow AF is generated during operation of the heat source unit 20.

The air flow AF passes through the central air flow path FP1 or the cool air flow path FP2 and is discharged outside of the casing 30. Specifically, the air flow AF flowing in on the central air flow path FP1 flows upward and is discharged from the vent 321.

A portion of the air flow AF flows on the cool air flow path FP2 through the inlet 63. The air flow AF flowing in on the cool air flow path FP2 flows upward. The air flow AF flowing on the cool air flow path FP2 is subjected to heat exchange with the main body part 491 and the heat-radiating fins 492 of the heat sink 49 disposed inside the cool air flow path FP2. Heat radiation by the heat sink 49 is thereby accelerated. The air flow AF flowing on the cool air flow path FP2 flows out from the cool air flow path FP2 through the outlet 64. The air flow AF flowing out from the cool air flow path FP2 goes toward the vent 321 together with the air flow AF flowing on the central air flow path FP1, and is discharged outside of the casing 30 through the vent 321.

Here, as described above, the area at the outlet 64 of the cool air flow path FP2 is larger than the area of the other portion of the cool air flow path FP2 when viewed from the direction of flow of the air flow AF. Therefore, the air flow AF flows out stably from the outlet 64 on the cool air flow path FP2. As a result, the air flow AF flows in stably into the cool air flow path FP2. The flow speed of the air flow AF flowing on the cool air flow path FP2 thereby tends not to decrease. That is, during operation of the heat source unit 20, the air flow AF stably flows by the periphery of the main body part 491 and the heat-radiating fins 492 of the heat sink 49.

The plurality of fins of the heat-radiating fins 492 in the present embodiment extends in the top-to-bottom direction (vertical direction). Meanwhile, in the heat source unit 20, the air flow flows into the casing 30 from the side. Therefore, if the rectifying member 60 were not provided, it would be difficult for the air flow AF to pass stably between the fins of the heat-radiating fins 492.

As illustrated in FIG. 4, the heat-radiating fins 492 also are disposed in the corner portion of the casing 30 where it is difficult for the air flow AF to pass. The heat-radiating fins 492 furthermore are fixed to the back face side of the partitioning plate 50 where it is difficult for the air flow AF to pass. Therefore, if the rectifying member 60 were not provided, it would be difficult for the air flow AF to pass stably by the periphery of the heat-radiating fins 492.

(4) Features of the Heat Source Unit 20

The heat source unit 20 of the present embodiment has the following features.

(A) As mentioned above, a heat source unit 20 of an air-conditioning apparatus 100 comprises a heat source-side heat exchanger 42, a heat source unit blower 46, a heat source unit controller 47 including various electrical components, a rectifying member 60, and a casing 30. The heat source unit controller 47 controls driving of an actuator. The rectifying member 60 rectifies the flow of air. The casing 30 houses the heat source-side heat exchanger 42, the heat source unit blower 46, the heat source unit controller 47, and the rectifying member 60. A vent 321 for venting air upward is formed on the casing 30. The heat source unit controller 47 includes a heat-generating part and a heat sink 49. The heat sink 49 is installed on the heat-generating part. The heat sink 49 has heat-radiating fins 492. The rectifying member 60 covers the heat-radiating fins 492. The rectifying member 60 extends along the vertical direction. An inlet 63 for air flow AF is formed on a lower part of the rectifying member 60. An outlet 64 for air flow AF is formed on an upper part 62 of the rectifying member 60. The rectifying member 60 forms a cool air flow path FP2 inside. The air flow AF generated by the heat source unit blower 46 passes by on the cool air flow path FP2. The heat-radiating fins 492 are positioned inside the cool air flow path FP2.

The air flow AF thereby stably passes by the periphery of the heat-radiating fins 492 during operation of the heat source unit 20, and heat exchange between the heat sink 49 and the air flow AF is stably accomplished. As a result, the performance of the heat sink 49 tends not to degrade.

(B) As mentioned above, the heat-radiating fins 492 extend along the vertical direction. Because the heat-radiating fins 492 extend along the vertical direction in the heat source unit 20, the air flow AF stably passes by the periphery of the heat-radiating fins 492 even when conditions are such that it would be difficult for the air flow AF to stably pass by the periphery of the heat-radiating fins 492.

(C) As mentioned above, the cross-sectional area of the outlet 64 of the rectifying member 60 is larger than the other portion.

In the heat source unit 20, the flow speed of the air flow AF passing through the cool air flow path FP2 thereby tends not to decrease. The air flow thereby stably passes by the periphery of the heat-radiating fins 492, and heat exchange between the heat sink 49 and the air flow AF is stably accomplished.

(D) As mentioned above, the heat source unit 20 comprises a partitioning plate 50. The partitioning plate 50 is placed inside the casing 30. The partitioning plate 50 partitions the space inside the casing 30 into a machine compartment SP1 and an electrical components compartment SP2. The heat source unit blower 46 is positioned in the machine compartment SP1. The heat source unit controller 47 is fixed on the partitioning plate 50. The heat-generating part is positioned in the electrical components compartment SP2. The heat-radiating fins 492 are positioned in the machine compartment SP1. The rectifying member 60 is disposed on a plate face of the partitioning plate 50 on a side facing the machine compartment SP1.

The air flow AF thereby stably passes by the periphery of the heat-radiating fins 492 during operation of the heat source unit 20, and heat exchange between the heat sink 49 and the air flow AF is stably accomplished.

As mentioned above, the heat source-side heat exchanger 42 has a first side face part 421, a second side face part 422, a third side face part 423, and a fourth side face part 424. The second side face part 422 is adjacent to the first side face part 421. The third side face part 423 is opposite the first side face part 421 and adjacent to the second side face part 422. The fourth side face part 424 is opposite the second side face part 422 and adjacent to the third side face part 423. The first side face part 421 faces the side face configured by the first side face grill 331 (that is, one side face of the casing 30). The fourth side face part 424 faces the side face configured by the second side face grill 332 (that is, one side face of the casing 30). The end part of the first side face part 421 (that is, the first tube plate 42*a*) configures one end of the heat source-side heat exchanger 42. The electrical components compartment SP2 is positioned in a corner formed by the side face configured by the first side face grill 331 and the side face configured by the second side face grill 332. The partitioning plate 50 is positioned between the end part of the first side face part 421 and the end part of the fourth side face part 424.

In the heat source unit 20, the air flow AF stably passes by the periphery of the heat-radiating fins 492 even when conditions are such that it would be difficult for the air flow AF to stably pass by the periphery of the heat-radiating fins 492.

(5) Modified Examples (A) In the above embodiment, the rectifying member 60 was configured in a shape as illustrated in FIGS. 9 to 11. However, the rectifying member 60 is not limited to that structure; design changes are possible provided that the shape covers the heat-radiating fins 492. For example, the rectifying member 60 may have a roughly U shape or a roughly V shape in plan view.

(B) In the above embodiment, the rectifying member 60 had a base part 61 and an upper part 62. However, the rectifying member 60 may be configured with only a base part 61, omitting an upper part 62.

(C) The rectifying member 60 of the above embodiment may be replaced with a rectifying member 60*a*. The rectifying member 60*a* is described below. Descriptions are omitted concerning portions that are the same as those of the rectifying member 60.

Figure 12:
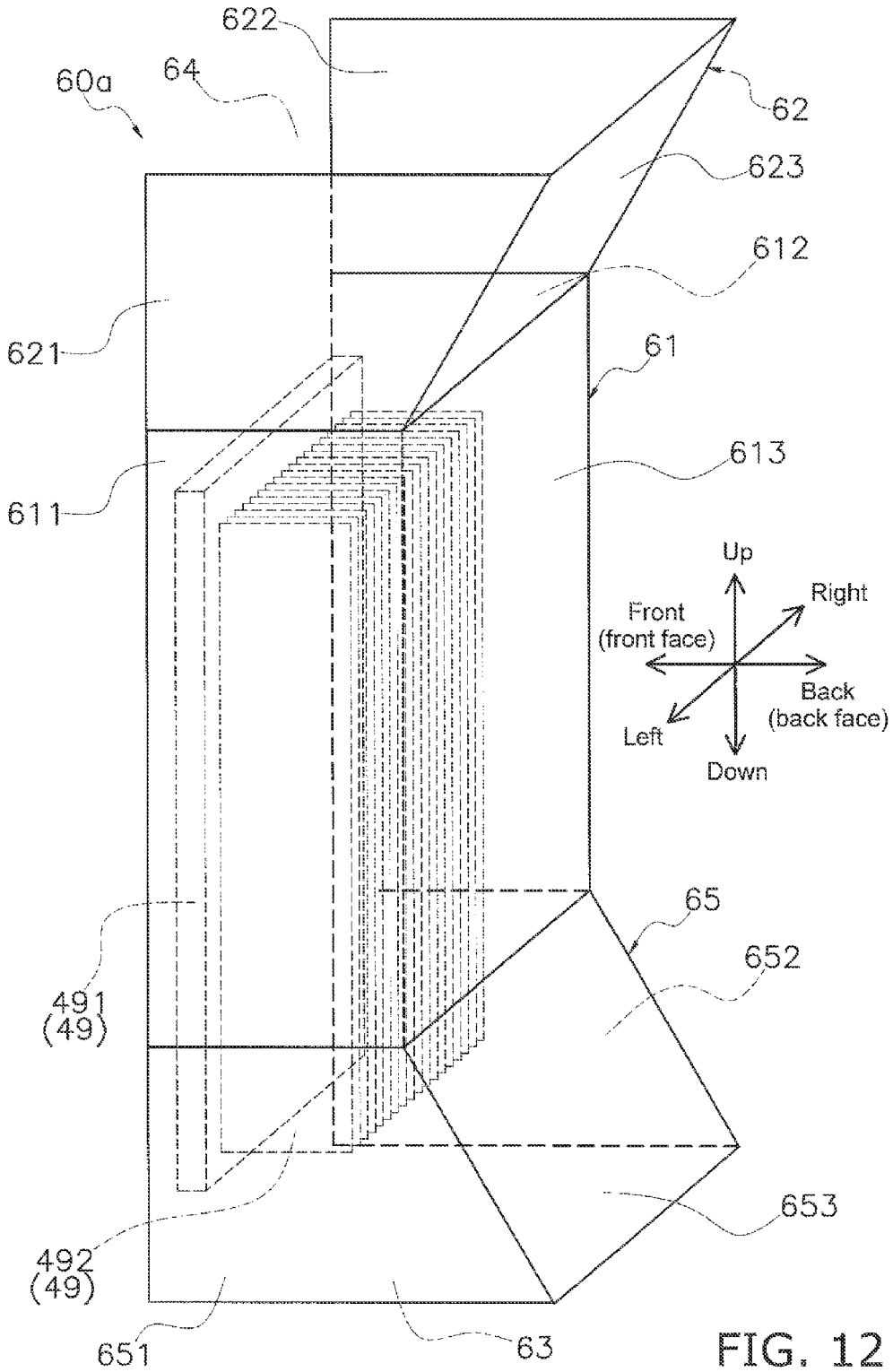
FIG. 12 is an external perspective view of the rectifying member according to modified example C.

FIG. 12 is an external perspective view of the rectifying member 60*a*. The rectifying member 60*a* further includes a lower part 65 in addition to the configuration of the rectifying member 60. The lower part 65 is provided beneath the base part 61. Specifically, the lower part 65 extends downward from a lower end of the base part 61. The lower part 65 includes a lower left side part 651, a lower right side part 652, and a lower back face part 653.

The lower left side part 651 configures a left end portion of the lower part 65. The lower left side part 651 has a roughly trapezoidal shape in which the width (length in the front-to-back direction) widens going downward. Specifically, the length of the bottom edge of the lower left side part 651 is longer than the length of the top edge. The lower right side part 652 configures a right end portion of the lower part 65. The lower right side part 652 has roughly the same shape as the lower left side part 651, and is disposed so as to face opposite the lower left side part 651. The lower back face part 653 configures a back face portion of the lower part 65. The lower back face part 653 is disposed between the lower left side part 651 and the lower right side part 652. The lower back face part 653 has a roughly trapezoidal shape in which the width (length in the left-to-right direction) widens going downward. Specifically, the length of the bottom edge of the lower back face part 653 is longer than the length of the top edge.

The rectifying member 60*a* configured as above has an inlet 63 formed on a lower end portion of the lower part 65. In the rectifying member 60*a*, the area of the inlet 63 in plan view is larger than the area of the other portion (excluding the outlet 64) of the rectifying member 60*a*. That is, the cross-sectional area of the inlet 63 is larger than the cross-sectional area of the other portion (excluding the outlet 64) of the rectifying member 60*a*.

In the cool air flow path FP2 formed by placement of the rectifying member 60*a*, the area of the inlet 63 is larger than the other portion (excluding the outlet 64) of the cool air flow path FP2 when viewed from the direction of flow of the air flow AF. Therefore, when the rectifying member 60*a* is placed, the air flow AF flows in more stably from the inlet 63, and the flow speed of the air flow AF flowing on the cool air flow path FP2 is less likely to decrease. The air flow AF thereby more stably passes by the periphery of the main body part 491 and the heat-radiating fins 492 of the heat sink 49 during operation of the heat source unit 20.

The lower part 65 of the rectifying member 60*a* described above is configured in a shape in which the lower left side part 651, the lower right side part 652, and the lower back face part 653 have a roughly trapezoidal shape in which the width widens going downward and the length of the bottom edge is longer than the length of the top edge. However, it is not necessarily required that the lower back face part 653 be configured in a roughly trapezoidal shape in which the width widens going downward. That is, the lower part 65 may be configured such that the length of the bottom edge is longer than the length of the top edge with respect to the lower left side part 651 and the lower right side part 652, but the length of the bottom edge may be roughly the same as the length of the top edge with respect to the lower back face part 653.

Figure 13:
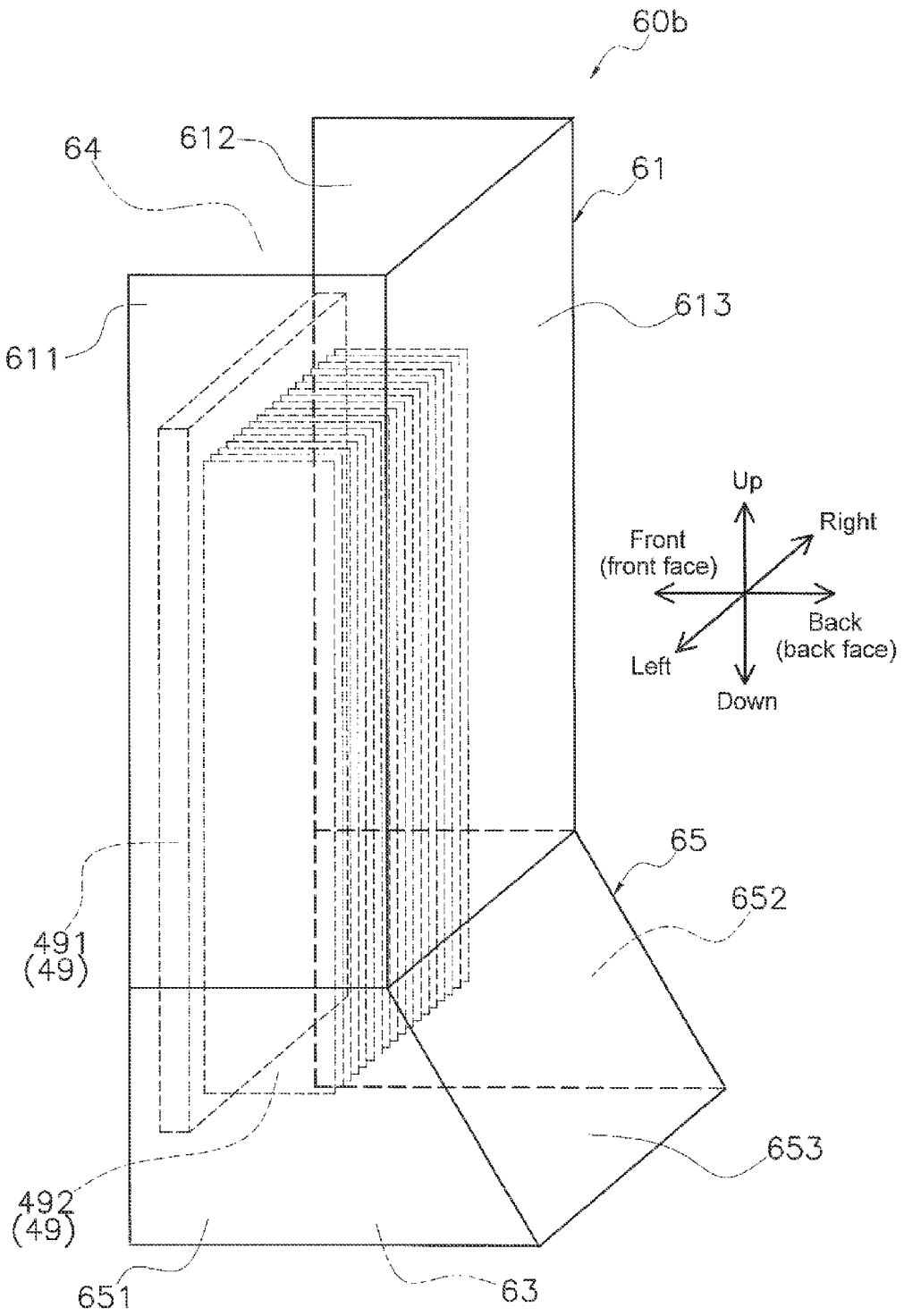
FIG. 13 is an external perspective view of the rectifying member according to modified example D.

(D) The rectifying member 60 or rectifying member 60*a* described above may be replaced with a rectifying member 60*b* illustrated in FIG. 13. FIG. 13 is an external perspective view of the rectifying member 60*b*. In the rectifying member 60*b*, the upper part 62 is omitted in the configuration of the rectifying member 60*a*.

In the cool air flow path FP2 formed by placement of the rectifying member 60*b*, the area of the inlet 63 is larger than the other portion of the cool air flow path FP2 when viewed from the direction of flow of the air flow AF. Therefore, when the rectifying member 60*b* is placed, the air flow AF flows in stably from the inlet 63 during operation of the heat source unit 20.

(E) The upper part 62 of the rectifying member 60 or 60*a* described above is configured in a shape in which the upper left side part 621, the upper right side part 622, and the upper back face part 623 have a roughly trapezoidal shape in which the width widens going upward and the length of the top edge is longer than the length of the bottom edge. However, it is not necessarily required that the upper back face part 623 be configured in a roughly trapezoidal shape in which the width widens going upward. That is, the upper part 62 may be configured such that the length of the top edge is longer than the length of the bottom edge with respect to the upper left side part 621 and the upper right side part 622, but the length of the top edge may be roughly the same as the length of the bottom edge with respect to the upper back face part 623.

What is claimed is:

1. A heat source unit of a refrigerating apparatus, comprising:

a heat exchanger;

a blower;

an electrical component configured to control driving of an actuator;

a rectifying member configured and arranged to rectify a flow of air;

a casing housing the heat exchanger, the blower, the electrical component, and the rectifying member, the casing having a vent configured and arranged to vent air upward; and a partitioning plate disposed inside the casing, the partitioning plate partitioning a space inside the casing into a first space and a second space, the blower being positioned in the first space, the electrical component being fixed to the partitioning plate, the electrical component including a heat-generating part, and a heat sink installed on the heat-generating part and having a heat-radiating fin, the heat-generating part being positioned in the second space, the rectifying member being disposed on a plate face of the partitioning plate on a side facing the first space, the rectifying member extending along a vertical direction and covering the heat-radiating fin, the rectifying member including an air inlet formed on a lower part and an air outlet formed on an upper part, and a first air flow path formed in an interior thereof, the first air flow path being configured and arranged to carry an air flow generated by the blower, and the heat-radiating fin being positioned in the first space, the heat-radiating fin being positioned inside the first air flow path.

2. The heat source unit of a refrigerating apparatus according to claim 1, wherein the heat-radiating fin extends along the vertical direction.

3. The heat source unit of a refrigerating apparatus according to claim 1, wherein a cross-sectional area of at least one of the air inlet and the air outlet of the rectifying member is larger than another portion of the rectifying member.

4. The heat source unit of a refrigerating apparatus according to claim 1, wherein the heat exchanger includes a first side face part facing a first side face of the casing, the first side face part having an end part forming a first end of the heat exchanger, a second side face part adjacent to the first side face part, a third side face part opposite the first side face part and adjacent to the second side face part, and a fourth side face part opposite the second side face part and adjacent to the third side face part, the fourth side face part facing a second side face of the casing and having an end part thereof forming a second end of the heat exchanger;

the second space is positioned in a corner formed by the first side face and the second side face; and the partitioning plate is positioned between the end part of the first side face part and the end part of the fourth side face part.

5. A heat source unit of a refrigerating apparatus, comprising:

a heat exchanger;

a blower;

an electrical component configured to control driving of an actuator;

a rectifying member configured and arranged to rectify a flow of air;

a casing housing the heat exchanger, the blower, the electrical component, and the rectifying member, the casing having a vent configured and arranged to vent air upward; and a partitioning plate disposed inside the casing, the partitioning plate partitioning a space inside the casing into a first space and a second space, the blower being positioned in the first space, the electrical component being fixed to the partitioning plate, the electrical component including a heat-generating part, and a heat sink installed on the heat-generating part and having a heat-radiating fin, the heat-generating part being positioned in the second space, the rectifying member being disposed on a plate face of the partitioning plate on a side facing the first space, the rectifying member extending along a vertical direction and covering the heat-radiating fin, the rectifying member including an air inlet formed on a lower part and an air outlet formed on an upper part, and a first air flow path formed in an interior thereof, the first air flow path being configured and arranged to carry an air flow generated by the blower, the heat-radiating fin being positioned in the first space, the heat-radiating fin being positioned inside the first air flow path, and the air inlet being positioned higher than the bottom plate of the casing.

* * * * *